US010316464B2

(12) United States Patent
Garcia et al.

(10) Patent No.: US 10,316,464 B2
(45) Date of Patent: Jun. 11, 2019

(54) PAINTABLE CLOTH BASED ON PLANT FIBERS

(71) Applicant: SAINT-GOBAIN ADFORS, Chambery (FR)

(72) Inventors: Alexandre Garcia, Paris (FR); Katarzyna Chuda, Asnieres sur Seine (FR)

(73) Assignee: SAINT-GOBAIN ADFORS, Chambery (FR)

( * ) Notice: Subject to any disclaimer, the term of this patent is extended or adjusted under 35 U.S.C. 154(b) by 544 days.

(21) Appl. No.: 14/904,627

(22) PCT Filed: Jul. 15, 2014

(86) PCT No.: PCT/FR2014/051817

§ 371 (c)(1),
(2) Date: Jan. 12, 2016

(87) PCT Pub. No.: WO2015/004404

PCT Pub. Date: Jan. 15, 2015

(65) Prior Publication Data

US 2016/0177502 A1 Jun. 23, 2016

(30) Foreign Application Priority Data

Jul. 12, 2013 (FR) ..... 13 56895

(51) Int. Cl.

| | |
|---|---|
| ***D06N 3/00*** | (2006.01) |
| ***D06N 7/00*** | (2006.01) |
| ***D03D 1/00*** | (2006.01) |
| ***D03D 15/00*** | (2006.01) |
| ***D06N 3/04*** | (2006.01) |

(52) U.S. Cl.

CPC ..... *D06N 3/0006* (2013.01); *D03D 1/0017* (2013.01); *D03D 15/00* (2013.01); *D03D 15/0077* (2013.01); *D06N 3/005* (2013.01); *D06N 3/0015* (2013.01); *D06N 3/042* (2013.01); *D06N 7/0002* (2013.01); *D06N 2201/045* (2013.01); *D06N 2203/028* (2013.01); *D06N 2209/105* (2013.01); *D10B 2201/04* (2013.01); *D10B 2201/06* (2013.01); *D10B 2201/08* (2013.01); *D10B 2403/0242* (2013.01); *D10B 2503/04* (2013.01)

(58) Field of Classification Search

CPC .. D06N 3/0006; D06N 7/0002; D06N 3/0015; D06N 3/005; D06N 3/042; D06N 2203/028; D06N 2201/045; D06N 2209/105; D03N 1/0017; D03N 15/00; D03N 15/0077; D10B 2201/04; D10B 2201/06; D10B 2201/08; D10B 2403/0242; D10B 2503/04

See application file for complete search history.

(56) References Cited

U.S. PATENT DOCUMENTS 5,436,064 A * 7/1995 Schnegg ..... A47H 23/08 442/203

FOREIGN PATENT DOCUMENTS

| | | | | |
|---|---|---|---|---|
| DE | 38 22 236 | A1 | | 1/1990 |
| EP | 1 964 966 | A1 | | 9/2008 |
| EP | 2 014 807 | A1 | | 1/2009 |
| EP | 2602385 | | * | 6/2012 |
| EP | 2 602 385 | A1 | | 6/2013 |
| JP | 11350342 | | * | 12/1999 |
| WO | WO 2004/003286 | A1 | | 1/2004 |
| WO | WO2004003286 | | * | 1/2004 |
| WO | WO 2010/070248 | A2 | | 6/2010 |

OTHER PUBLICATIONS

International Search Report as issued in International Patent Application No. PCT/FR2014/051817, dated Oct. 22, 2014.

* cited by examiner

*Primary Examiner* — Cephia D Toomer
(74) *Attorney, Agent, or Firm* — Pillsbury Winthrop Shaw Pittman LLP

(57) ABSTRACT

A paintable cloth includes a woven fabric including plant fibers, especially flax, jute, ramie and/or sisal fibers, the woven fabric additionally being coated with a finish.

20 Claims, No Drawings

PAINTABLE CLOTH BASED ON PLANT FIBERS

CROSS-REFERENCE TO RELATED APPLICATIONS

This application is the U.S. National Stage of PCT/FR2014/051817, filed Jul. 15, 2014, which in turn claims priority to French patent application number 1356895 filed Jul. 12, 2013. The content of these applications are incorporated herein by reference in their entireties.

The invention relates to a paintable cloth based on plant fibers that is intended to be applied as a wallcovering for buildings, in particular for residential use.

Paintable wallcoverings are divided into two categories:

- nonwoven fabrics (or "nonwovens") based on cellulose, optionally combined with a polymer, in particular polyester, which generally comprise structural patterns obtained by embossing, and
- woven fabrics (or "paintable cloths") of natural or synthetic fibers, especially glass fibers.

Nonwovens are easy to apply and are inexpensive. Their role is essentially decorative: the variety of structural patterns that can be obtained is very large and in general nonwovens do not require any treatment after hanging such as the application of paint. However, they do not have very good abrasion resistance and they participate very little in reinforcing the support to which they are applied.

Woven fabrics of natural fibers of plant or animal origin are generally laminated onto a paper support which is then bonded to the wall, or hung on rods fixed at the periphery of the walls.

Woven glass fabrics are particularly advantageous. They have excellent mechanical properties, especially high abrasion resistance and high tensile strength which enables them to carry out the role of reinforcing material for the support to which they are applied. Woven glass fabrics are also rot-proof and fireproof.

Nevertheless, most woven glass fabrics have the drawback of irritating the skin of the people who have to handle them during manufacture or when hanging on the wall.

The objective of the present invention is to propose a paintable cloth that has mechanical properties superior to those of nonwoven coverings, especially improved tensile strength and water resistance that approach those of paintable glass cloths, and which do not cause skin irritations.

In order to achieve this objective, the present invention proposes a paintable cloth consisting of a woven fabric comprising plant fibers, said woven fabric being coated with a finish.

The term "finish" is understood to mean the product resulting from the drying of a finishing composition that is in the form of an aqueous solution of constituents capable of endowing the woven fabric with properties specific to the intended use. In particular, the finish ensures the bonding of the plant fibers, imparts suppleness to the paintable cloth and improves its abrasion resistance.

The paintable cloth in accordance with the invention consists of a woven fabric obtained from yarns composed of a multitude of plant fibers (or strands) or derivatives of these yarns, especially the assemblies of these yarns into yarns of higher linear density.

Preferably, the aforementioned yarns composed of flax, jute, ramie and/or sisal fibers, preferably flax and/or jute fibers and advantageously flax fibers. Yarns consisting of fibers derived from a single plant are preferred.

The aforementioned yarns may be non-twisted yarns or twisted yarns.

Advantageously, the woven fabric comprises, as warp, a twisted yarn (textile yarn) and, as weft, a non-twisted yarn that is generally in the form of a ribbon which may have undergone a treatment that aims to separate the plant fibers so as to give them volume ("volumized yarn"). The linear density of the warp and weft yarns varies from 50 to 500 tex, preferably 100 to 350 tex.

The woven fabric may optionally contain fibers consisting of another material, especially glass fibers, advantageously in the form of textile yarns arranged as warp. The glass incorporated in the composition of the yarns may be of any type, for example E, C, R or AR (alkali-resistant) glass, preferably E glass.

The amount of glass does not however exceed 50 percent of the weight of the plant fibers. Preferably, the woven fabric contains only plant fibers, advantageously flax, jute, ramie and/or sisal fibers, more particularly flax and/or jute fibers and more advantageously flax fibers.

The diameter of the glass filaments forming the yarns may vary to a large extent, for example from 5 to 30 μm. The linear density of the glass yarn is identical to that of the plant fiber yarns.

The woven fabric may have a plain, twill or satin weave.

The woven fabric incorporated in the composition of the paintable cloth has a basis weight that varies from 30 to 1000 g/m$^2$, preferably from 50 to 300 g/m$^2$ and advantageously from 75 to 200 g/m$^2$.

As indicated above, the paintable cloth additionally comprises a finish which maintains the yarns of the woven fabric, conceals the pores and gives it the appropriate stiffness so that positioning on the final support can be carried out in a suitable manner. Preferably, the finish is present on both sides of the paintable cloth.

Generally, the finish comprises the constituents below, in the following proportions expressed as weight percentages of solids:

- 5% to 75% of a starchy compound,
- 20% 55% of at least one acrylic polymer, and
- 1.5% to 5% of a crosslinking agent, for example an ammonium zirconium carbonate.

Preferably, the starchy compound is a starch, advantageously consisting of more than 50% by weight of a starch that is soluble in cold water, that is to say at a temperature of from 20° C. to 25° C. Advantageously, the soluble starch is a starch that has been chemically modified in order to give it the targeted solubility.

More preferably, the acrylic polymer is a homopolymer or copolymer of (meth)acrylic acid or an alkyl (meth)acrylate, preferably a styrene/(meth)acrylic acid or alkyl (meth)acrylate/acrylonitrile copolymer.

The finish may additionally contain conventional additives, such as a mineral filler (including a pigment), a foaming agent, a foam stabilizer, a softener, a thickener, an optical brightener and a biocide and/or fungicide.

Preferably, the mineral filler is titanium oxide, calcium carbonate and mixtures thereof, and better still titanium oxide for its advantageous white color.

More preferably, the foaming agent is an amine oxide.

According to a first variant suitable for pad coating as is explained later on, the finish contains the constituents below, in the following proportions, expressed as weight percentages of solids:

- 30% to 50% of starch,
- 30% to 50% of at least one styrene/(meth)acrylic acid copolymer, 2% to 5% of ammonium zirconium carbonate,
0.1% to 5% of a foaming agent,
0.1% to 5% of a foam stabilizer, and
0 to 25% of a mineral filler.

According to a second variant suitable for roll (screen-to-screen) coating as is explained later on, the finishing composition contains the constituents below, in the following proportions, expressed as weight percentages of solids:

5% to 65% of starch,
15% to 55% of at least one acrylic polymer,
1.5% to 5% of ammonium zirconium carbonate,
0 to 4% of a softener,
0 to 10% of a thickener, and
0 to 20% of a mineral filler.

The paintable cloth may comprise a supplementary layer composed of a water-reactivatable adhesive on its underside (side which in the final layout is bonded to the support). Such a layer enables the operator, by simply applying water to the coated side, to reactivate the adhesive-coated side and position the cloth directly on the support.

The manufacture of the paintable cloth according to the invention may be carried out in a conventional facility that is suitable for the manufacture of paintable glass cloths, for example described in WO 2010/070248.

In this facility, use is made of a finishing composition that is in the form of an aqueous solution containing the aforesaid constituents in the proportions mentioned above. The water content in the finishing composition varies as a function of the method of application, and in general represents 30% to 90% of the total weight of the finishing composition, preferably 70% to 90%.

The paintable cloth, unwound from a reel, passes into a device that makes it possible to deposit a finishing composition on the cloth, then into a device that makes possible to eliminate the water and to crosslink the constituents of said composition in order to form the final finish.

The device for applying the finishing composition may be a pad-coating machine composed of a pair of rolls arranged so that the first, lower roll immerses in a tank containing the finishing composition and the second roll is positioned above the first roll. The amount of finishing composition deposited is regulated by the distance between the two rolls.

The device for applying the finishing composition may also consist of two rolls that each comprise a central pipe introducing the finishing composition under pressure. The peripheral region of the rolls is provided with perforations through which the finishing composition passes, which composition is deposited on the paintable cloth. This device makes it possible to spread the finishing composition over both sides of the paintable cloth. The application using this device is known as screen-to-screen coating.

The device for drying the paintable cloth may consist of a series of several rolls heated to an identical temperature or to different temperatures, in particular the first roll being heated to a temperature above that of the last roll.

The temperature to be applied to the first roll is at most equal to 290° C. The temperature of the roll must also be adapted as a function of the run speed of the paintable cloth over this roll. It is important that the temperature measured at the paintable cloth does not exceed 250° C. in order not to damage the plant fibers.

Other drying devices may be used, for example devices that deliver hot air or operate by infrared radiation.

The following examples make it possible to illustrate the invention without however limiting it.

In these examples, the tensile strength of the woven fabrics of plant and glass fibers is measured in the machine direction (warp direction) and in the cross direction (weft direction) under the conditions of the NF EN ISO13934-1 standard.

The tensile strength of these woven fabrics is measured after manufacture (TSm) and after an aging treatment (TSa) that consists in immersing the woven fabric in distilled water at 80° C. for 10 minutes.

EXAMPLE 1

This example illustrates the manufacture of a paintable cloth on a pilot line.

An aqueous finishing composition is prepared that contains the following constituents, in weight percentages:

| | |
|---|---|
| Styrene/acrylic copolymer[1] | 11.3 |
| Modified potato starch[2] | 5.4 |
| Ammonium zirconium carbonate[3] | 2.0 |
| Ammonium stearate[4] | 0.7 |
| Amine oxide[5] | 0.3 |
| Titanium oxide[6] | 0.3 |
| Water | 80.0 |

The finishing composition is used to coat a woven flax fabric having a width equal to 30 cm and a basis weight equal to 80 g/m$^2$ comprising, as warp, a (twisted) flax textile yarn having a linear density equal to 125 tex with a warp density of 3.1 yarns per cm and, as weft, a non-twisted flax yarn having a linear density of 200 tex with a weft density of 1.8 yarns per cm.

The finishing composition is applied using a pad-coating machine.

The woven flax fabric then passes into an oven (230° C.; length: 5 m) speed 0.5 m/min. On leaving the oven the woven fabric has a basis weight equal to 109 g/m$^2$.

By way of comparison, the finishing composition is applied under the same conditions as above to a woven glass fabric having a basis weight equal to 88.0 g/m$^2$ consisting, as warp, of (twisted) textile yarns made of glass having a linear density equal to 140 tex with a warp density of 3.0 yarns per cm and, as weft, (non-twisted) glass yarns having a linear density of 220 tex with a weft density of 1.7 yarns per cm. The final woven glass fabric has a basis weight equal to 121.0 g/m$^2$.

The measurements of the tensile strength of the woven fabrics made of flax (example 1) and of glass (comparative example 1) are given in table 1.

EXAMPLE 2

An aqueous finishing composition is prepared that contains the following constituents, in weight percentages:

| | |
|---|---|
| Styrene/butyl acrylate copolymer[7] | 5.9 |
| Acrylic ester/acrylonitrile copolymer[8] | 10.9 |
| Modified potato starch[2] | 26.1 |
| Wheat starch | 1.0 |
| Ammonium zirconium carbonate[3] | 3.4 |
| Calcium carbonate[9] | 2.5 |
| Silicone-based softener [10] | 0.3 |
| Water | 49.9 |

The finishing composition is used to coat a woven flax fabric having a basis weight equal to 160 g/m$^2$ comprising, as warp, a (twisted) flax textile yarn having a linear density equal to 200 tex with a warp density of 3.1 yarns per cm and, as weft, a non-twisted flax yarn having a linear density of 300 tex with a weft density of 1.8 yarns per cm.

The finishing composition is applied according to a dip-coating process which consists in immersing the woven fabric in a tank containing said finishing composition then in depositing the woven fabric on a suction belt so as to eliminate the excess finish. The dip-coating application is equivalent to the screen-to-screen application mentioned above.

The woven flax fabric is then placed in an oven at 210° C. for 4 minutes. On leaving the oven the woven fabric has a basis weight equal to 229 g/m$^2$.

As a comparative example, the finishing composition is applied under the same conditions as above to a woven glass fabric having a basis weight equal to 146.2 g/m$^2$ consisting, as warp, of (twisted) textile yarns made of glass having a linear density equal to 280 tex with a warp density of 1.5 yarns per cm and, as weft, (non-twisted) glass yarns having a linear density of 550 tex with a weft density of 1.9 yarns per cm. The final woven glass fabric has a basis weight equal to 195.0 g/m$^2$.

Still for comparison purposes, the tensile strength of two textured nonwoven paintable coverings was measured: one covering based on cellulose fibers (Vlisfaser® 707 sold by Erfurt; basis weight: 165 g/m$^2$; comparative example 3) and an expanded vinyl paper (Superfresco® sold by Graham & Brown; basis weight: 200 g/m$^2$; comparative example 4).

Table 1 collates the measurements of the tensile strength of the woven fabrics made of flax (example 2) and of glass (comparative example 2) and also of the nonwoven paintable coverings (comparative examples 3 and 4).

The paintable cloths made of flax according to the invention (examples 1 and 2) have a tensile strength, after manufacture and after aging, which is always greater than that of the nonwoven coverings (comparative examples 3 and 4).

The paintable cloth from example 2 has a tensile strength before and after ageing which is greater than that of the paintable cloth made of glass (comparative example 2). Without wanting to be tied to any one scientific explanation, the inventors believe that this is due to a better impregnation of the flax yarns by the finish compared to the glass yarns (in particular of the weft yarns which are not twisted) and to a better compatibility of the finish with the cellulose constituting the flax yarns.

[1]: Acronal® S589 sold by the company BASF; 52% solids

[2]: Amitrolit® 8900 sold by the company Agrana; 90% solids

[3]: AZC® sold by the company Auer Remy; 20% solids

[4]: ammonium stearate sold by the company Peer Greven; 30% solids

[5]: Genaminox® sold by the company Clariant; liquid with 100% active material

[6]: XWO5® sold by the company Ecofix AB; 59% solids

[7]: Acronal® S996 sold by the company BASF; 46% solids

[8]: Acronal® LN579S sold by the company BASF; 50% solids

[9]: Hydrocarb® 90-GU sold by the company Omya; 78% solids

[10]: Cepolsoft® SIL sold by the company Prochimica; 16% solids

TABLE 1

| Tensile strength (N/5 cm) | Ex. 1 | Comp. ex. 1 | Ex. 2 | Comp. ex. 2 | Comp. ex. 3 | Comp. ex. 4 |
|---|---|---|---|---|---|---|
| after manufacture (TSm) | | | | | | |
| machine direction | 265.8 | 647.1 | 514.0 | 573.1 | 208.9 | 241.4 |
| cross direction | 295.8 | 335.5 | 896.7 | 509.6 | 233.6 | 141.6 |
| after aging (TSa) | | | | | | |
| machine direction | 233.7 | 389.8 | 475.2 | 318.4 | 75.8 | 54.2 |

The invention claimed is:

1. A paintable cloth comprising a woven fabric consisting of plant fibers, said woven fabric additionally being coated with a finish, wherein the finish comprises the constituents below, in the following proportions expressed as weight percentages of solids:

5% to 75% of a starchy compound,

20% 55% of at least one acrylic polymer, and 1.5% to 5% of a crosslinking agent.

2. The paintable cloth as claimed in claim 1, wherein the plant fibers are in the form of a yarn.

3. The paintable cloth as claimed in claim 1, wherein the plant fibers are flax, jute, ramie and/or sisal fibers.

4. The paintable cloth as claimed in claim 1, wherein the woven fabric comprises, as warp, a twisted yarn and, as weft, a non-twisted yarn.

5. The paintable cloth as claimed in claim 4, wherein the non-twisted yarn is a volumized yarn.

6. The paintable cloth as claimed in claim 1, wherein a linear density of warp and weft yarns of the woven fabric varies from 50 to 500 tex.

7. The paintable cloth as claimed in claim 1, wherein the woven fabric has a basis weight that varies from 30 to 1000 g/m$^2$.

8. The paintable cloth as claimed in claim 1, wherein the finish is present on both sides of the paintable cloth.

9. The paintable cloth as claimed in claim 1, wherein the starchy compound consists of more than 50% by weight of a starch that is soluble in water at a temperature of from 20° C. to 25° C.

10. The paintable cloth as claimed in claim 1, wherein the acrylic polymer is a homopolymer or copolymer of (meth) acrylic acid or an alkyl acrylate.

11. The paintable cloth as claimed in claim 1, wherein the finish contains, as a weight percentages of solids:

30% to 50% of starch,

30% to 50% of at least one styrene/(meth)acrylic acid copolymer,

2% to 5% of ammonium zirconium carbonate, 0.1% to 5% of a foaming agent, 0.1% to 5% of a foam stabilizer, and 0 to 25% of a mineral filler.

12. The paintable cloth as claimed in claim 1, wherein the finish contains, as a weight percentages of solids:

5% to 65% of starch,

15% to 55% of at least one acrylic polymer, 1.5% to 5% of ammonium zirconium carbonate, 0 to 4% of a softener, 0 to 10% of a thickener, and 0 to 20% of a mineral filler.

13. The paintable cloth as claimed in claim 1, further comprising a supplementary layer composed of a water-reactivatable adhesive on its underside.

14. The paintable cloth as claimed in claim 3, wherein the plant fibers are flax and/or jute fibers.

15. The paintable cloth as claimed in claim 14, wherein the plant fibers are flax fibers.

16. The paintable cloth as claimed in claim 6, wherein the linear density of the warp and weft yarns varies from 100 to 350 tex.

17. The paintable cloth as claimed in claim 7, wherein the woven fabric has a basis weight that varies from 50 to 300 $g/m^2$.

18. The paintable cloth as claimed in claim 17, wherein the woven fabric has a basis weight that varies from 75 to 200 $g/m^2$.

19. The paintable cloth as claimed in claim 1, wherein the crosslinking agent is an ammonium zirconium carbonate.

20. The paintable cloth as claimed in claim 10, wherein the acrylic polymer is a styrene/(meth)acrylic acid or alkyl acrylate/acrylonitrile copolymer.

* * * * *